US005966995A

United States Patent [19]

Edwards, Jr. et al.

[11] Patent Number: 5,966,995

[45] Date of Patent: Oct. 19, 1999

[54] DEVICE FOR PROVIDING AXIAL AND SPATIAL MISALIGNMENT COMPENSATION BETWEEN A ROTATABLE COMPONENT AND A ROTATING MEANS

[75] Inventors: Stanley H. Edwards, Jr., Raleigh; T. Ray Robbins, Zebulon; Barry Edward Powell, Raleigh, all of N.C.

[73] Assignee: Square D Company, Palatine, Ill.

[21] Appl. No.: 09/055,542

[22] Filed: Apr. 6, 1998

Related U.S. Application Data

[63] Continuation of application No. 08/542,216, Oct. 12, 1995, Pat. No. 5,735,179.

[51] Int. Cl.[6] ..... G05G 1/10

[52] U.S. Cl. ..... 74/553; 74/10 R; 200/11 R; 200/28; 200/308

[58] Field of Search ..... 74/10 R, 10.1, 74/10.22, 10.41, 527, 531, 553; 200/11 A, 11 D, 11 R, 19 R, 28, 308, 336; 464/88

[56] References Cited

U.S. PATENT DOCUMENTS

| | | | |
|---|---|---|---|
| 3,150,506 | 9/1964 | Alcaro | 464/88 |
| 3,393,535 | 7/1968 | Morin | 464/88 |
| 4,011,513 | 3/1977 | Kawachi | 74/10 R X |
| 4,141,226 | 2/1979 | Sasahara | 74/10 R X |
| 4,449,955 | 5/1984 | Watanabe et al. | 74/10 R X |
| 5,735,179 | 4/1998 | Edwards, Jr. et al. | 74/553 |

*Primary Examiner*—Charles A Marmor
*Assistant Examiner*—Saul J. Rodriguez
*Attorney, Agent, or Firm*—David R. Stacey; Larry T. Shrout; Larry I. Golden

[57] ABSTRACT

An operating shaft which provides compensation for axial and spatial misalignment between a rotatable component mounted within an enclosure and a rotating apparatus generally outside the enclosure is disclosed. The operating shaft has a first end dimensioned to be slidably received within a receiving portion of the rotating apparatus such that the shaft is maintained in a fixed angular position with respect to the rotating apparatus. The shaft is axially slidable with respect to the rotating apparatus such that it will provide compensation for axial misalignment between the rotatable component and the rotating apparatus. The shaft has a second end configured to engage the rotatable component such that rotation of the rotating apparatus will produce a corresponding rotation of the rotatable component. The shaft also has a spatial compensation device which is integrally formed from the shaft between the first and second ends. The spatial compensation device provides compensation for spatial misalignment between the axis of the rotatable component and the axis of the rotatable apparatus. This is accomplished by creating a compensating angle between the first and second ends which permits the shaft to be rotated about its axis while maintaining the compensating angle.

20 Claims, 5 Drawing Sheets

DEVICE FOR PROVIDING AXIAL AND SPATIAL MISALIGNMENT COMPENSATION BETWEEN A ROTATABLE COMPONENT AND A ROTATING MEANS

This application is a continuation of application Ser. No. 08/542,216 filed Oct. 12, 1995 and issued as U.S. Pat. No. 5,735,179, on Apr. 7, 1998.

FIELD OF THE INVENTION

This invention relates to electromechanical components enclosed within a protective housing and more specifically to components located inside the housing which require a rotational operation or adjustment from an external source.

BACKGROUND OF THE INVENTION

It is common practice to install rotatable electronic and electromechanical components within housings. If these components require a rotational input from outside the housing they are usually either placed near the housing wall to ensure alignment with the external rotating means or large clearance holes are placed in the housing to allow for misalignment. In many applications it is desirable to locate the rotatable component at some distance away from the housing wall. In these cases a special component which has a shaft of sufficient length to pass through the housing wall such that the external operating means can be attached is generally required. These special components increase the product cost and may dictate the component location within the housing. In today's miniaturization of electronic components it is desirable to preassemble components on printed circuit boards which are then installed within the housings. Due to manufacturing tolerances a precise location of the rotatable component within the housing is not always cost effective. Therefore, some misalignment between the rotatable components and access openings provided in the housing are to be expected. These misalignments may cause a binding of the component shaft or the external rotating means. If there is a binding of the shaft or the external rotating means, the electronic component may not operate in a precise manner. Further, there is a possibility that the printed circuit board to which the component is attached may fail due to a combination of stress in its printed wiring due to the misalignment and vibration to which the device is subjected. It is therefore desirable to provide an inexpensive means to compensate for axial and angular misalignment between the rotatable component located within the housing and its external operating means.

SUMMARY OF THE INVENTION

The present invention provides an inexpensively manufactured operating shaft and an associated external indicator for use with standard rotatable components which have been preassembled on printed circuit boards to be installed within a housing. This operating shaft and its associated external indicator provide compensation for axial and spatial misalignment between the rotatable component and the external indicator located in an access opening provided in the housing wall. The operating shaft includes a first end that is dimensioned to be slidably received within a receiving portion of the indicator such that the shaft is maintained in a fixed angular position with respect to the indicator. The operating shaft is axially slidable with respect to the indicator, while maintaining its fixed angular position with respect to the indicator, such that compensation is provided for any axial misalignment between the rotatable element and the indicator. The operating shaft has a second end dimensioned to engage the rotatable element such that a rotation of the indicator will produce a precise like rotation of the rotatable element. The operating shaft also has a spatial compensation device, which is integrally formed in the shaft between its first and second ends. The spatial compensation device provides compensation for any spatial misalignment between the axis of the indicator and the axis of the rotatable element. The spatial compensation device creates a compensation angle between the first and second ends of the operating shaft. This compensation angle is maintained with respect to the positions of the indicator and the rotatable element as the indicator is turned, thus compensating for any spatial misalignment between the rotatable element and the indicator.

Other features and advantages of the invention will become apparent to those skilled in the art upon review of the following detailed description, claims and drawings.

Figure 1:
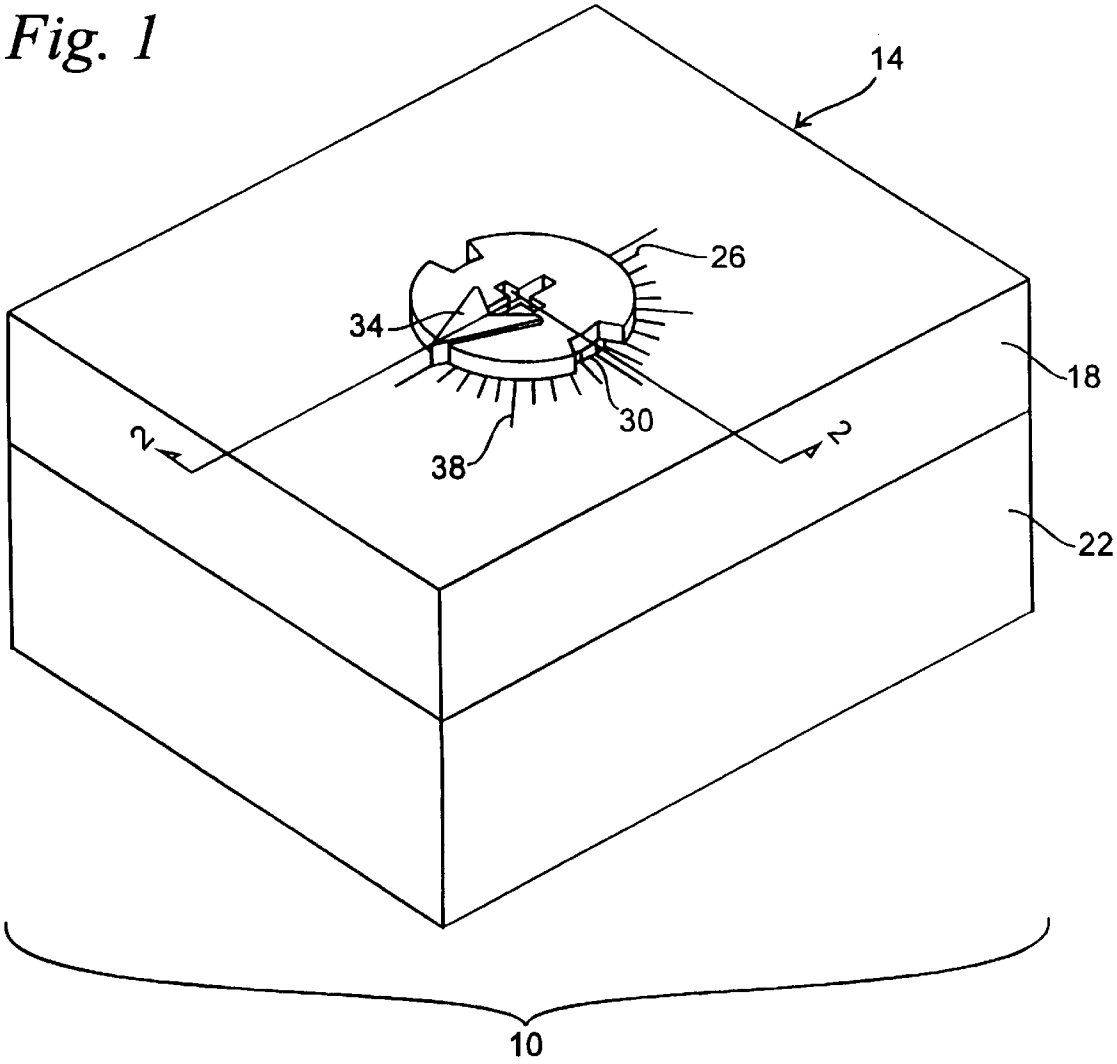
FIG. 1 is an isometric view of the exterior of an electronic device enclosure with an indicator attached thereto.

Before one embodiment of the invention is explained in detail, it is to be understood that the invention is not limited in its application to the details of construction and description or illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

Referring to FIG. 1, an enclosed electronic device constructed in accordance with the present invention is generally indicated by the reference numeral 10. The enclosure 14 is generally constructed with a top half 18 and a bottom half 22 to facilitate assembly by allowing components of the device to be easily placed in the bottom half 22 (top down assembly) with the top half 18 being installed after all of the components are in place. The two halves 18 and 22 can be held together by any suitable means such as snap-fit, screws, rivets, adhesive, welding, etc. An indicator 26 is provided for rotatably operating a component located inside the enclosure 14. An access opening 30 is provided in the enclosure 14 for receiving the indicator 26. In this embodiment, the access opening 30 is located in the top half 18 of the enclosure 14. In the preferred embodiment, the indicator 26 includes a pointer 34 for indicating a particular orientation of the component being rotated with respect to some form of indicia 38 located immediately adjacent the access opening 30. This indicia 38 may be either integrally formed in the enclosure surface or a label placed on the enclosure surface.

Figure 2:
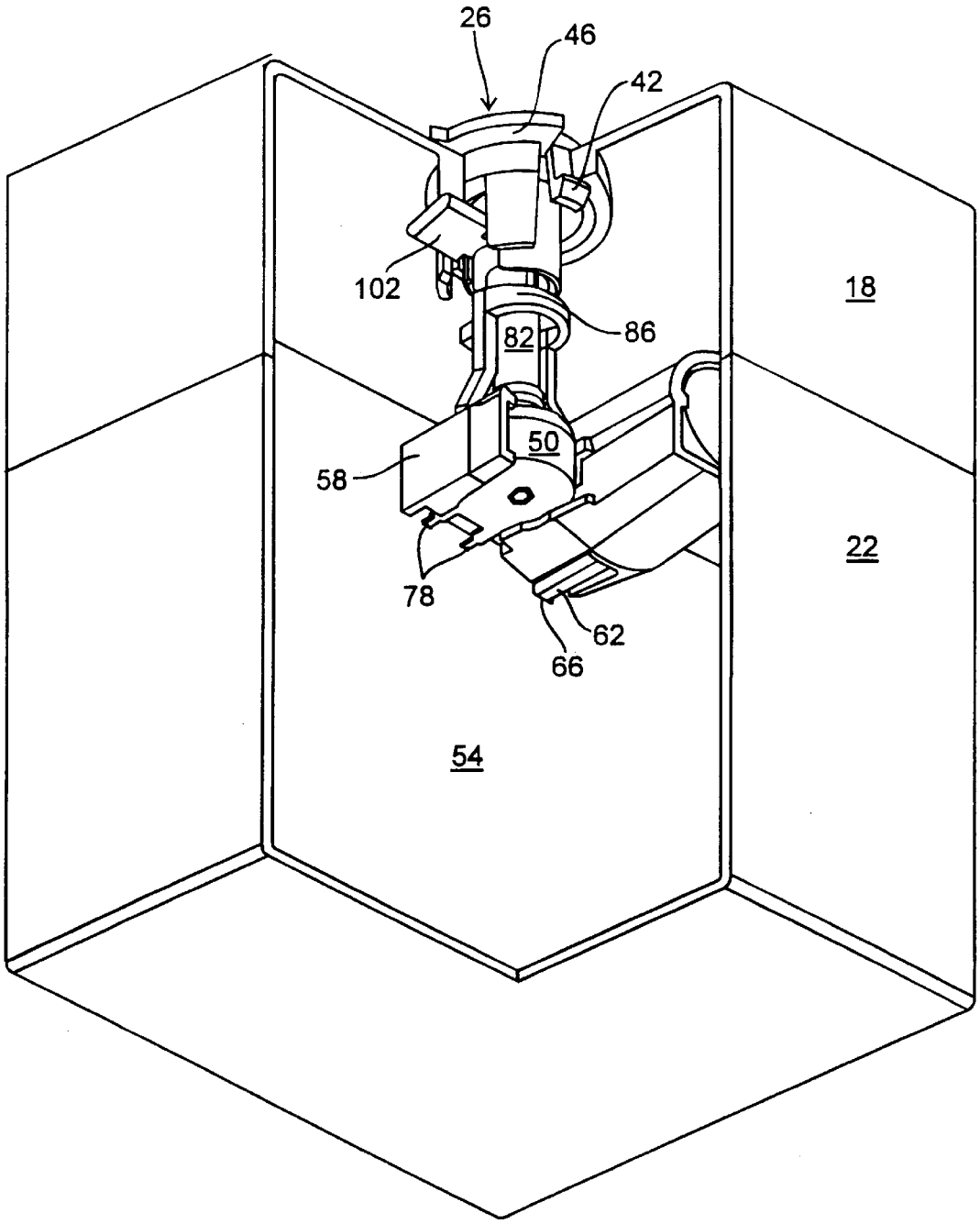
FIG. 2 is a section view of the enclosure taken along lines 2—2 of FIG. 1.

Referring now to FIG. 2, it can be seen that the indicator 26 is rotatably retained within the access opening 30 by a latch 42 and a flange 46 integrally formed from the indicator 26. The latch 42 flexibly deforms as the indicator 26 is pressed into the access opening 30 from outside the enclosure and then returns to its normal position in which it engages a portion of the inside surface of the enclosure. The flange 46, which has a larger diameter than the access opening 30, prevents the indicator 26 from being pushed completely through the access opening 30. The latch 42 and flange 46 permit the indicator 26 to be easily installed after the housing halves 18 and 22 have been assembled. A rotatable component 50, in the illustrated embodiment a potentiometer, is installed on a printed circuit board 54. The assembled printed circuit board 54 is slidably received within the bottom housing 22 during assembly of the electronic device 10.

Figure 3:
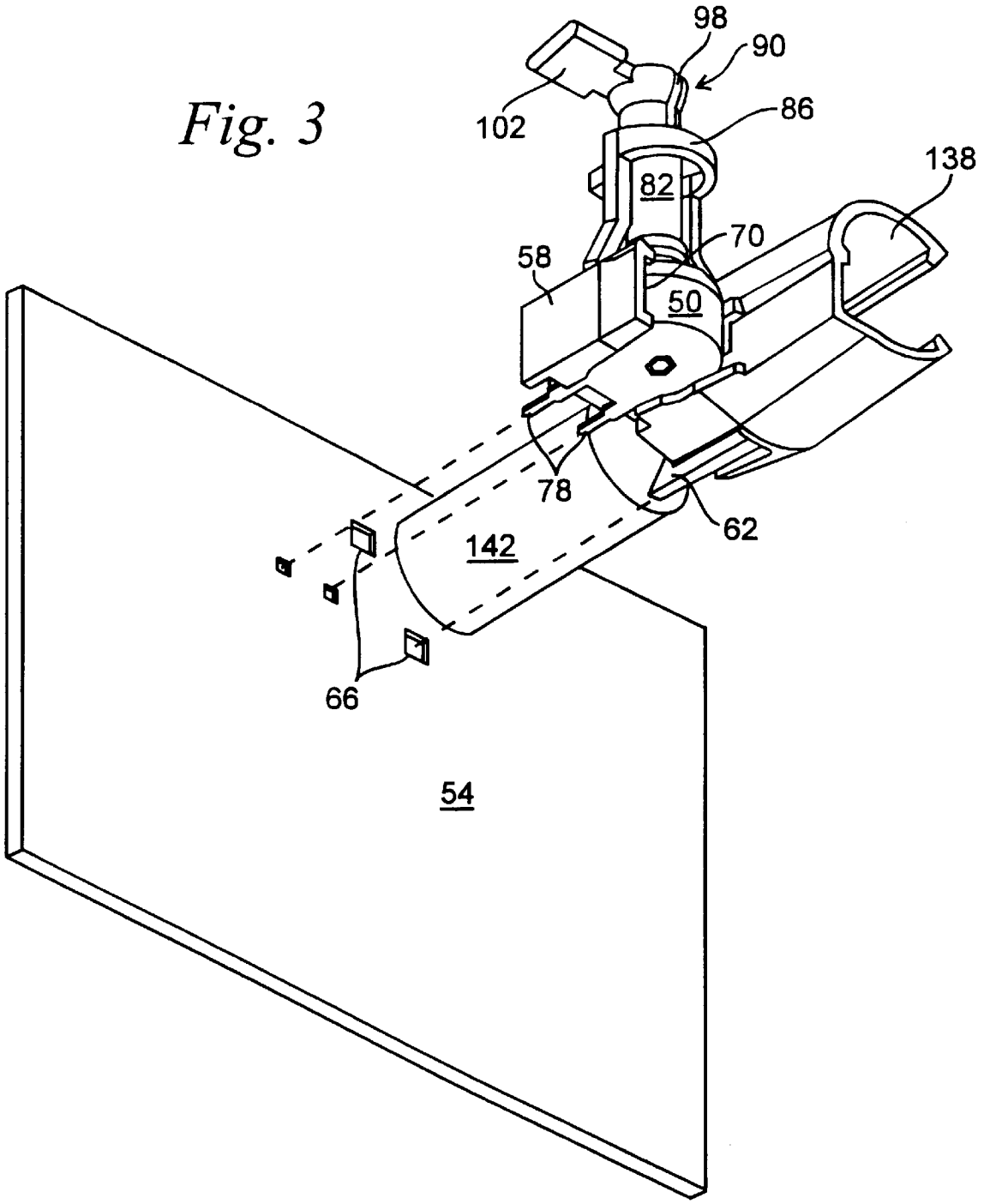
FIG. 3 is an assembled printed circuit board including the component support and operating shaft.

Referring now to FIG. 3, a component support 58 is attached to the printed circuit board 54 prior to wave soldering of the components to the printed circuit board 54. The component support 58 is attached to the printed circuit board 54 by number of flexible barbs 62, similar to the latches 42 of the indicator 26. These barbs 62 are received in holes 66 located in the printed circuit board 54. The potentiometer 50 is slidably received within a pocket 70, integrally formed from the component support 58, and held in place by small snaps 74 (shown in FIG. 4) located in the pocket 70. The component support 58 holds the potentiometer 50 in a particular position with respect to the printed circuit board 54. A shaft member 82 mechanically connects the indicator 26 with the potentiometer 50 such that rotation of the indicator 26 is transmitted to the potentiometer 50. The component support 58 also includes a shaft support 86 which, prior to assembly of the printed circuit board 54 and during assembly of the electronic device 10, loosely maintains the shaft 82 in a position that will permit the indicator 26 to engage the shaft member 82 as the indicator 26 is being installed in the access opening 30.

Figure 4:
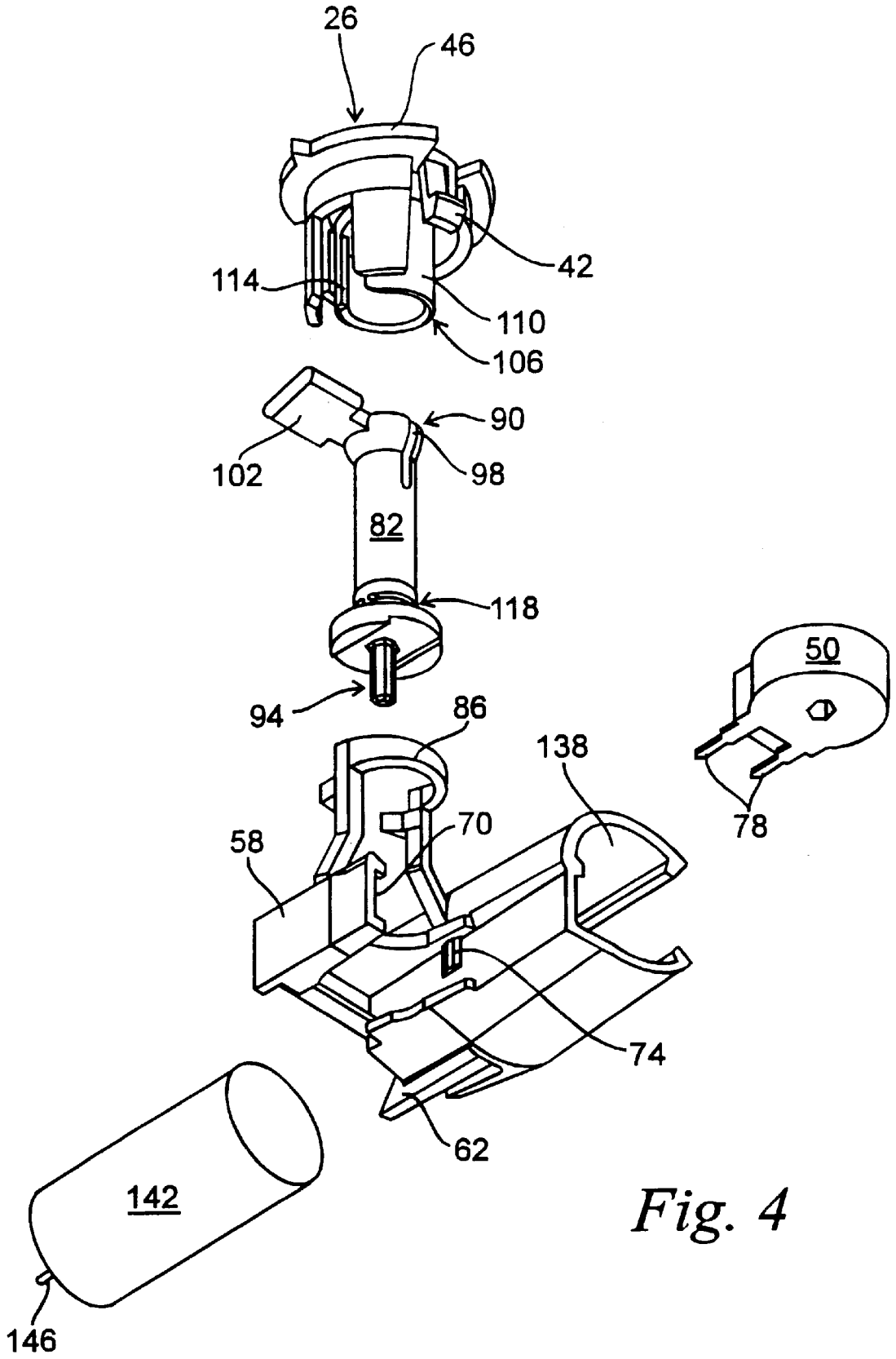
FIG. 4 is an exploded view of the component support including capacitor and potentiometer, operating shaft and indicator.

Referring now to FIG. 4, the shaft member 82 includes a first end generally indicated by reference numeral 90 and a second end generally indicated by reference numeral 94. The first end 90 is generally rounded and is bisected by a slot 98 extending along a portion of the axis of the shaft member 82. The first end 90 also includes a tongue 102 extending outwardly from and general perpendicularly to the shaft member 82. The tongue 102 extends outwardly from one of the two halves created by the slot 98 such that the plane of the tongue 102 is generally perpendicular to the plane of the slot 98. The indicator 26 includes a receiving portion generally indicated as reference numeral 106. The receiving portion 106 includes a receiving tube 110 that extends axially outward from the bottom of the indicator 26. The receiving tube 110 has an indexing or alignment slot 114 extending along its length which gives the receiving tube 110 a generally C-shaped cross-section. The centerline of the alignment slot 114 coincides with the point of the pointer 34. The alignment slot 114 is dimensioned to slidably but snugly receive the tongue 102 of the shaft member 82. The inside diameter of the receiving tube 110 is dimensioned such that the two halves of the rounded first end 90 of the shaft member 82 will be slightly compressed into the slot 98 as the first end 90 of the shaft member 82 enters the receiving tube 110, thereby ensuring a snug fit. The snug fit of the tongue 102 in the alignment slot 114 and the rounded first end 90 within the receiving tube 110 ensures that rotation of the shaft member 82 will coincide precisely with that of the indicator 26. The second end of the shaft member 94 is dimensioned to precisely engage the rotatable component 50 such that a precise rotational movement of the shaft member 82 will produce a corresponding precise movement of the rotatable component 50.

Figure 5:
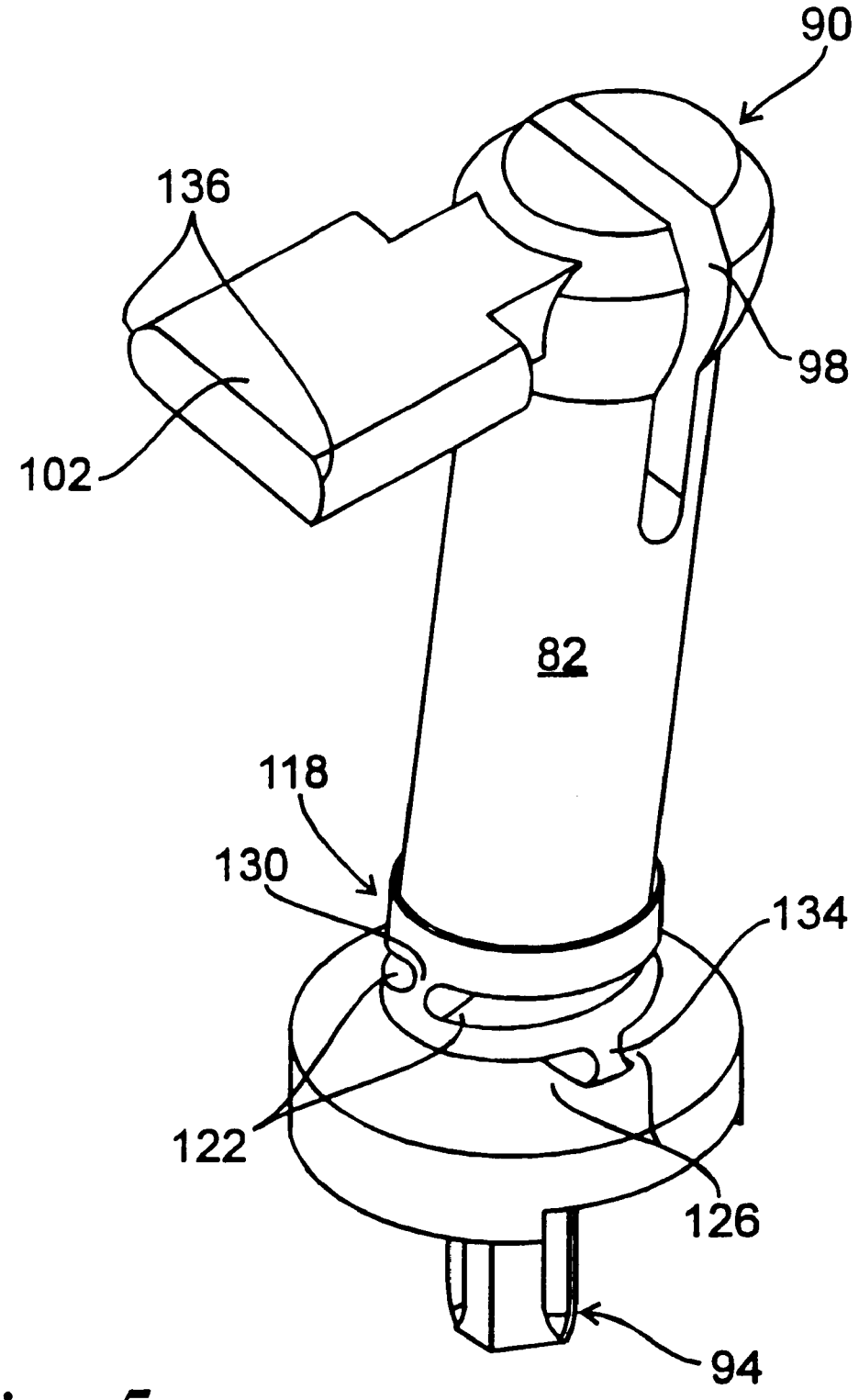
FIG. 5 is a view of the spatial compensation means of the operating shaft.

Referring now to FIG. 5, the shaft member 82 further includes a spatial compensation means generally indicated by reference numeral 118. The spatial compensation means 118 is integrally formed from the shaft member 82 and located between the first end 90 and the second end 94 such that a compensating angle can be formed between the first and second ends, 90 and 94 respectively. This compensating angle provides compensation for spatial misalignment between the axis of the indicator 26 and the axis of the rotatable component 50. The compensating angle formed between the first end 90 and the second end 94 is maintained as the shaft member 82 is rotated. The spatial compensation means 118 includes a first pair of opposed grooves 122 and a second pair of opposed grooves 126. The first pair of opposed grooves 122 lie in a first common plane, which is generally perpendicular to the axis of the shaft member 82. The first pair of grooves 122 are separated by a first flexible web 130 also lying in the first common plane and being in a plane generally parallel to the axis of the shaft member 82. The second pair of grooves 126 also lie in a second common plane which is generally perpendicular to the axis of the shaft member 82 and are separated by a second flexible web 134 lying in the second common plane and in a plane generally parallel to the axis of the shaft member 82. The first and second pairs of grooves, 122 and 126, respectively, and their associated flexible webs 130 and 134 are generally at right angles to one another. The position of the first pair of grooves 122 and first flexible web 130 with respect to the second pair of grooves 126 and second flexible web 134 permits the shaft member 82 to form the compensating angle between its first and second ends, 90 and 94, respectively. This is accomplished by moving one end of the shaft member 82 (usually the first end 90) in the direction required to compensate for the spatial misalignment between the axis of the indicator 26 and the axis of the rotatable component 50. This causes one of the flexible webs 130 or 134 to flex, thereby closing one of the grooves of either of the first or second pairs of grooves, 122 or 126, respectively, while the other groove of that pair is opened. As the shaft member 82 is rotated, the other of the flexible webs 130 or 134 begins to flex in the direction of the compensating angle causing the adjacent groove of the other pair of grooves 122 or 126 in the direction of rotation of the shaft member 82, to begin to close as the other groove of that pair begins to open. As the shaft member 82 continues to rotate, the other flexible web 130 or 134 begins to flex in the direction of the compensating angle causing the other of the first or second pairs of grooves, 122 or 126 respectively, to begin closing as the other groove of that pair begins to open. This closing and opening of the grooves 122 and 126 continues in sequence as the shaft member 82 rotates about its axis. Thus the compensating angle between the first and second ends, 90 and 94 respectively, is maintained as the shaft member 82 rotates. The tongue 102 has rounded sides 136 which ensure that the width of the tongue 102 will remain constant as the first end 90 of the shaft member 82 is moved to form the compensating angle required to compensate for spatial misalignment between the indicator 26 and the rotatable component 50. The rounded sides 136 ensure that the snug slidable fit between the alignment slot 114 and the tongue 102 is maintained.

Referring again to FIG. 3, the component support 58 also includes a passage 138 for receiving a vibration sensitive component 142, such as a capacitor, which is solely supported by its electrical leads 146. The component support 58 protects the capacitor 142 from failing due to vibration. The small electrical leads 146, which normally provide the electrical and mechanical connection between the capacitor 142 and the printed circuit board 54, can be easily broken if the electronic device 10 is subjected to vibration over a period of time. Since the component support 58 is attached to the printed circuit board 54 by the flexible barbs 62 the mass of the capacitor 142 extending outwardly from the printed circuit board 54 is supported by the component support 58 and not by its electrical leads 146. This prevents flexing of the electrical leads 146 due to vibration of the device 10 from causing a failure of the capacitor 142 due to the breaking of one of its electrical leads 146.

While a specific embodiment has been illustrated and described, it will be understood by those skilled in the art that numerous modifications are possible without departing from the scope of the invention.

We claim:

1. A compensating device for providing axial and spatial misalignment compensation between a rotatable component mounted within an enclosure and a rotating means being generally external to the enclosure, said compensating device comprising:

a shaft member having a first end, formed to be snugly but slidably received within a receiving portion of the rotating means such that said shaft member is maintained in a fixed angular position with respect to the rotating means and its rotational axis which is generally perpendicular to a surface of the enclosure through which the receiving portion of the rotating means passes, said shaft being axially slidable with respect to the rotating means such that axial misalignment between the rotatable component and the rotating means can be compensated for, and a second end, said second end engaging the rotatable component such that a rotation of the rotating means will produce a like rotation of the rotatable component; and a spatial compensation means, integrally formed from said shaft member between said first and second ends such that a compensating angle can be formed between said first and second ends of said shaft member, said shaft member being rotatable about its axis while maintaining said compensating angle such that compensation for spatial misalignment between the rotational axis of the rotatable component and the rotational axis of the rotating means is provided.

2. The compensating device of claim 1, wherein said spatial compensation means further comprises:

a first pair of opposed grooves partially defined by a first common plane which is generally perpendicular to the axis of said shaft member;

a first flexible web also partially defined by said first common plane, said first flexible web defining a first solid portion of said shaft member which extends through the rotational axis of said shaft member axis proximate the intersection of said first common plane and the rotational axis of said shaft member, thereby separating said first pair of opposed grooves;

a second pair of opposed grooves partially defined by a second common plane which is also generally perpendicular to the rotational axis of said shaft member;

a second flexible web also partially defined by said second common plane, said second flexible web defining a second solid portion of said shaft member which extends through the rotational axis of said shaft member proximate the intersection of said second common plane and the rotational axis of the shaft member, thereby separating said second pair of opposed grooves; and said first and second solid portions of said shaft member, defined by said first and second flexible webs, respectively, being generally disposed at right angles to one another.

3. The compensating device of claim 2, wherein said compensating angle is formed by closing one groove of said first or second pairs of opposed grooves while opening the other groove of that pair of opposed grooves.

4. The compensating device of claim 3, wherein said compensating angle is rotated by closing one groove of the other of said first or second pairs of opposed grooves and opening the other of that pair of said opposed grooves in the direction of rotation of said shaft member, said opening and closing of said grooves alternating between said first and second pairs of grooves as said shaft member is rotated, thereby maintaining said compensating angle.

5. A compensating device for providing axial and spatial misalignment compensation between a rotatable component mounted within an enclosure and a rotating means generally external to and rotatably supported by a surface of the enclosure such that its rotational axis maintains a generally perpendicular relationship with the supporting surface, said compensating device comprising:

a shaft member having a first end and a second end, said first end adapted to be snugly but slidably received within a receiving portion of the rotating means such that said shaft member is maintained in a fixed angular position with respect to the rotating means and its rotational axis, said first end of said shaft member further being adapted to be axially slidable with respect to the receiving portion of the rotating means such that axial misalignment between the rotatable component and the rotating means can be compensated for, said second end configured to engage the rotatable component for rotation thereof; and a spatial compensation means, integrally formed from said shaft member between said first and second ends such that a compensating angle can be formed between said first and second ends of said shaft member, said shaft member being rotatable about its axis while maintaining said compensating angle, thereby providing compensation for spatial misalignment between the axis of the rotatable component and the axis of the rotating means.

6. The compensating device of claim 5 wherein said spatial compensation means further comprises:

a first pair of opposed grooves partially defined by first common plane which is generally perpendicular to the rotational axis of said shaft member;

a first flexible web also partially defined by said first common plane, said first flexible web defining a first solid portion of said shaft member which extends through the rotational axis of said shaft member axis proximate the intersection of said first common plane and the rotational axis of said shaft member, thereby separating said first pair of opposed grooves;

a second pair of opposed grooves partially defined by a second common plane which also is generally perpendicular to the rotational axis of said shaft member;

a second flexible web also partially defined by said second common plane, said second flexible web defining a second solid portion of said shaft member which extends through the rotational axis of said shaft member proximate the intersection of said second common plane and the rotational axis of the shaft member, thereby separating said second pair of opposed grooves; and said first and second solid portions of said shaft member, defined by said first and second flexible webs, respectively, being generally disposed at right angles to one another.

7. The compensating device of claim 6 wherein said compensating angle is formed by closing one groove of said first or second pairs of opposed grooves while opening the other groove of that pair of opposed grooves.

8. The compensating device of claim 7 wherein said compensating angle is rotated by closing one groove of the other of said first or second pairs of opposed grooves and opening the other groove of that pair of said opposed grooves in the direction of rotation of said shaft member, said opening and closing of said grooves alternating between said first and second pairs of grooves as said shaft member is rotated, thereby maintaining said compensating angle.

9. A connecting device for connecting a rotatable indicator to a rotatable component for precise common movement thereof, the rotatable indicator and the rotatable component having generally parallel axes of rotation while being spatially displaced one from the other in both the horizontal and the vertical direction, the rotatable component being enclosed within a housing having at least one surface lying in a plane substantially perpendicular to the rotational axis of the rotatable component and defining an opening therein for access to the rotatable component, said connecting device comprising:

a portion of the rotatable indicator defining a receiving tube adapted to pass through the access opening defined in the at least one surface of the housing; and a shaft member being continuous along its rotational axis between a first end and a second end, said first end adapted to be indexed with said receiving tube of the rotatable indicator and said second end adapted to be indexed with the rotatable component such that a precise movement of the rotatable indicator about its rotational axis produces a corresponding precise movement of the spatially displaced rotatable component about its rotational axis;

said first end of said shaft member, while maintaining said shaft member in precise rotational registry with the rotatable indicator, also permitting said shaft member to be slidingly displaced in an axial manner within said receiving tube of the rotatable indicator, and further, to be articulated such that an angle can be formed between the rotational axis of the rotatable indicator and said rotational axis of said shaft member, said angle being maintained as the rotatable indicator is rotated about its rotational axis and said shaft member is rotated about its said rotational axis;

said shaft member further defining a spatial compensation means located between said first and second ends, said spatial compensation means permitting said rotational axis of said shaft member to form an angle between said first and second ends of said shaft member, said angle being maintained as said shaft member is rotated about its rotational axis; and said spatial compensation means and said first end of said shaft member permitting said shaft member to connect the rotatable indicator to the vertically and horizontally displaced rotatable component for common movement thereof.

10. The device of claim 9, wherein said receiving tube of said portion of the rotatable indicator has a generally C-shaped cross-section formed by an axially extending slot in said receiving tube.

11. The device of claim 10, wherein said first end of said shaft includes a tongue extending outwardly from and generally perpendicular to said rotational axis of said shaft, said tongue being snugly but slidably received within said axially extending slot such that an angular relationship between the rotational axis of the rotatable indicator and said rotational axis of said shaft is maintained.

12. The device of claim 11, wherein said tongue include rounded sides forming a radius from its axis such that its width is maintained regardless of its angular position with respect to said alignment slot thereby ensuring a snug slidable fit within said alignment slot.

13. The device of claim 9, wherein said spatial compensation means further comprises:

a first pair of opposed grooves partially defined by a first common plane which is generally perpendicular to said rotational axis of said shaft member;

a first flexible web partially defined by said first common plane intermediate said first pair of opposed grooves, said first flexible web being integral with and perpendicular to said rotational axis of said shaft member;

a second pair of opposed grooves partially defined by a second common plane which is generally perpendicular to said rotational axis of said shaft member;

a second flexible web also partially defined by said second common plane intermediate said second pair of opposed grooves, said second flexible web being integral with and perpendicular to said axial axis and generally disposed at right angles to said first flexible web.

14. The device of claim 13, wherein said compensating angle is formed by closing one groove of said first or second pairs of opposed grooves while opening the other groove of that pair of opposed grooves as said shaft is rotated about said rotational axis of said shaft member.

15. The device of claim 14, wherein said compensating angle is rotated by closing one groove of the other of said first or second pairs of opposed grooves and opening the other groove of that pair of said opposed grooves in the direction of rotation of said shaft member, said opening and closing of said grooves alternating between said first and second pairs of grooves as said shaft member is rotated thereby maintaining said compensating angle.

16. A device for connecting a rotatable indicator to a rotatable component for common movement thereof, the rotatable indicator and rotatable component having generally parallel axes of rotation while being spatially displaced one from the other in both the horizontal and the vertical directions, said device comprising:

a shaft member having a rotational axis continuously extending between a first indexing means and a second indexing means and defining a spatial compensation means between said first and second indexing means, said first indexing means adapted to precisely index said shaft member with the rotatable indicator and said second indexing means adapted to precisely index said shaft member with the rotatable component such that a precise movement of the rotatable indicator about its rotational axis produces a movement of said shaft member about its said rotational axis and thereby a corresponding precise movement of the rotatable component about its rotational axis;

said first indexing means, while maintaining said shaft member in precise rotational registry with the rotatable indicator, also permitting said first end of said shaft member to be slidably displaceable along the rotational axis of the rotatable indicator thus providing vertical spatial misalignment compensation, and, further, permitting articulation of said first indexing means such that an angle can be formed and maintained between the rotational axis of the rotatable indicator and said rotational axis of said shaft member at said first indexing means, said spatial compensation means permitting said shaft member to form an angle along said rotational axis of said shaft member and maintain said angle as said shaft member is rotated about its said rotational axis;

said first indexing means and said spatial compensation means providing horizontal spatial misalignment compensation between the rotatable indicator and the rotatable component.

17. The device of claim 16, wherein said first and second indexing means are integrally formed from said shaft member such that said first indexing means is dimensioned to snugly but slidably engage a portion of the rotatable indicator coinciding with its rotational axis and said second indexing means is dimensioned to snugly but slidably engage a portion of said rotatable component coinciding with its rotational axis.

18. The device of claim 17, wherein said first indexing means can only be engaged by the rotatable indicator when the first indexing means is in a particular angular position with respect to the rotational indicator.

19. The device of claim 16, wherein said spatial compensation means further comprises:

a first pair of opposed grooves partially defined by a first common plane which is generally perpendicular to the rotational axis of said shaft member;

a first flexible web also partially defined by said first common plane intermediate said first pair of opposed grooves, said first flexible web being integral with and perpendicular to the rotational axis of said shaft member;

a second pair of opposed grooves partially defined by a second common plane which is generally perpendicular to the rotational axis of said shaft member;

a second flexible web also partially defined by said second common plane intermediate said second pair of opposed grooves, said second flexible web being integral with and perpendicular to the rotational axis of said shaft member and generally disposed at right angles with said first flexible web.

20. The compensating device of claim 19, wherein said compensating angle is rotated by closing one groove of the other of said first or second pairs of opposed grooves and opening the other groove of that pair of said opposed grooves in the direction of rotation of said shaft member, said opening and closing of said grooves alternating between said first and second pairs of grooves as said shaft member is rotated, thereby maintaining said compensating angle.

* * * * *